US007127858B2

(12) United States Patent
Layfield

(10) Patent No.: US 7,127,858 B2
(45) Date of Patent: Oct. 31, 2006

(54) INTERIOR WALL AND PARTITION CONSTRUCTION

(75) Inventor: Derek J. Layfield, Braeside (AU)

(73) Assignee: Strawmen, L.P., White Wright, TX (US)

( * ) Notice: Subject to any disclaimer, the term of this patent is extended or adjusted under 35 U.S.C. 154(b) by 0 days.

(21) Appl. No.: 11/243,227

(22) Filed: Oct. 4, 2005

(65) Prior Publication Data

US 2006/0026925 A1 Feb. 9, 2006

Related U.S. Application Data

(62) Division of application No. 10/714,830, filed on Nov. 14, 2003, now Pat. No. 7,032,356.

(60) Provisional application No. 60/496,176, filed on Aug. 19, 2003.

(51) Int. Cl.
*E04B 1/86* (2006.01)

(52) U.S. Cl. ..... 52/407.1; 52/404.3; 52/794.1

(58) Field of Classification Search ..... 52/404.3, 52/407.3, 407.1, 794.1, 481.1, 483.1, 407.4, 52/404.2, 404.4
See application file for complete search history.

(56) References Cited

U.S. PATENT DOCUMENTS 3,423,892 A * 1/1969 Rimington ..... 52/241
3,447,275 A * 6/1969 Henry et al. ..... 52/592.1
3,678,640 A * 7/1972 Tillie ..... 52/238.1
4,047,355 A * 9/1977 Knorr ..... 52/733.2
4,068,434 A * 1/1978 Day et al. ..... 52/220.1
4,147,004 A * 4/1979 Day et al. ..... 52/309.9
4,161,087 A * 7/1979 Levesque ..... 52/62
4,435,936 A * 3/1984 Rutkowski ..... 52/481.1
4,603,527 A * 8/1986 Vercelletto ..... 52/410
4,658,552 A * 4/1987 Mulford ..... 52/94
4,748,777 A * 6/1988 Glassco et al. ..... 52/82
4,879,850 A * 11/1989 Glassco et al. ..... 52/82
5,092,100 A * 3/1992 Lambert et al. ..... 52/774
5,398,472 A * 3/1995 Eichelkraut ..... 52/443
5,502,931 A * 4/1996 Munir ..... 52/144
5,761,864 A * 6/1998 Nonoshita ..... 52/302.3
5,907,932 A * 6/1999 LeConte et al. ..... 52/144
5,937,588 A * 8/1999 Gard ..... 52/79.1
5,953,883 A * 9/1999 Ojala ..... 52/794.1
6,061,986 A * 5/2000 Canada ..... 52/561
6,185,895 B1 * 2/2001 Rettew ..... 52/528
6,209,282 B1 * 4/2001 Lafrance ..... 52/729.1
6,240,704 B1 * 6/2001 Porter ..... 52/794.1
6,401,417 B1 * 6/2002 Leblang ..... 52/481.1
6,557,313 B1 * 5/2003 Alderman ..... 52/407.3
6,634,077 B1 * 10/2003 Layfield ..... 29/525.13
6,745,531 B1 * 6/2004 Egan ..... 52/302.1
6,761,004 B1 * 7/2004 Anglin et al. ..... 52/238.1
6,789,977 B1 * 9/2004 Layfield ..... 403/294
6,901,713 B1 * 6/2005 Axsom ..... 52/481.1

(Continued)

*Primary Examiner*—Brian E. Glessner
*Assistant Examiner*—Gay Ann Spahn
(74) *Attorney, Agent, or Firm*—Robert W. Brown; Robert H. Frantz

(57) ABSTRACT

An improved interior wall construction that provides both sound attenuating and fire resistant properties. The improved wall construction eliminates the need for conventional vertical studs by including at least one rigid interior structural panel comprised of compressed straw. A compressed straw panel is situated in a substantially layered configuration with conventional non-woven insulation, at least one air space and a gypsum board sheet on each face. Connection between the compressed straw panel and at least one gypsum board sheet is comprised semi-flexible substantially Z-shaped resilient channel members. The Z-shaped channel members and compressed straw panel each being capable of partially attenuating sound energy passed therethrough.

11 Claims, 14 Drawing Sheets

U.S. PATENT DOCUMENTS

2002/0162298 A1* 11/2002 Churchill et al. ..... 52/783.12
2003/0061777 A1* 4/2003 Alderman ..... 52/407.3
2003/0205010 A1* 11/2003 Anglin et al. ..... 52/238.1
2004/0000113 A1* 1/2004 Alderman ..... 52/407.5
2004/0068948 A1* 4/2004 Wrass ..... 52/309.7
2004/0103610 A1* 6/2004 Axsom ..... 52/481.1
2004/0221518 A1* 11/2004 Westra ..... 52/79.1
2005/0066618 A1* 3/2005 Tucker ..... 52/782.1
2005/0102969 A1* 5/2005 Burg ..... 52/782.1
2005/0188649 A1* 9/2005 Hagen ..... 52/782.1
2005/0210798 A1* 9/2005 Burg et al. ..... 52/481.1
2005/0223671 A1* 10/2005 Korman et al. ..... 52/607

* cited by examiner

PRIOR ART

PRIOR ART

PRIOR ART

INTERIOR WALL AND PARTITION CONSTRUCTION

CROSS-REFERENCE TO RELATED APPLICATIONS

This application is a divisional application of U.S. application Ser. No. 10/714,830, filed on Nov. 14, 2003, now U.S. Pat. No. 7,032,356 issued Apr. 25, 2006 which claimed benefit of U.S. Provisional Patent application Ser. No. 60/496,176, filed on Aug. 19, 2003, by Derek J. Layfield.

INCORPORATION BY REFERENCE

The related U.S. Provisional Patent application Ser. No. 60/496,176, filed on Aug. 19, 2003, by Derek J. Layfield, is hereby incorporated by reference in its entirety, including figures.

FEDERALLY SPONSORED RESEARCH AND DEVELOPMENT STATEMENT

This invention was not developed in conjunction with any Federally sponsored contract.

MICROFICHE APPENDIX

Not applicable.

BACKGROUND OF THE INVENTION

In modern office buildings, business and conference centers, hotels, classrooms, medical facilities, and the like, the fitting-out of occupiable space is continuously becoming more important and ever more challenging. In the competitive business environment, cost concerns alone dictate the efficient use of interior space. Thus, the finishing or fitting-out of building spaces for offices, hotel rooms, and similar areas has become a very important aspect of effective space planning and layout. Among many factors that designers and builders must consider is sound control. In hotels, for example, the prevention of sounds originating in one room from passing through walls and into adjacent rooms is of major concern.

Sound transmission through walls is typically expressed according to one of two single-number rating systems—Sound Transmission Class (STC) and Weighted Sound Reduction Index ($R_w$). Both are single-figure ratings schemes intended to rate the acoustical performance of a partition element under typical conditions involving office or dwelling separation. The higher the value of either rating, the better the sound insulation. The rating is intended to correlate with subjective impressions of the sound insulation provided against the sound of speech, radio, television, music, office machines and similar sources of sound characteristic of offices and dwellings.

The first rating system is called Sound Transmission Class (STC). STC is defined by the American Society for Testing Materials (ASTM) standard E 413. To assign an STC rating to a barrier separating two rooms, a sound is generated in one of the rooms, the sound power is measured on both sides of the barrier, and the ratio between the two measurements (the transmission loss) is stated in decibels. Sixteen measurements are made in each room, at ⅓ octave intervals from 125 HZ to 4000 HZ. The higher the STC rating, the greater the sound transmission loss. The E413 standard specifies a transmission loss curve having 16 points on the same ⅓ octave intervals. From 125 to 400 Hz, the curve slopes upward, 9 dB per octave; from 400 Hz to 1250 Hz, upward 3 dB per octave, and it is flat from 1250 Hz to 4000 Hz. The curve is moved up and down until the sum of all 16 differences between the curve values is a minimum. The Minimum must be less than 32 dB, providing no single difference is more than 8 dB. The rating is then expressed as the curve's loss in decibels at 500 Hz.

The second rating system is called Weighted Sound Reduction Index ("$R_w$") and is defined by International Standards Organization standard ISO 717. Test procedure for $R_w$ are similar to STC except the frequency range for $R_w$ spans 100–3150 HZ whereas, as indicated supra, STC covers a frequency range of 125–4000 Hz. STC and $R_w$ correlate very well. For architectural elements such as doors, windows and walls, differences in STC and $R_w$ are typically less than 1%.

Interior walls in offices, hotels and the like are typically made by erecting a frame that includes vertical studs, either wood or steel, on a 12" or 16" spacing, lining each side with gypsum board (sheet rock) panels, then finishing the wall surfaces with a variety of textures and paint. When additional thermal and/or acoustic insulation is needed, insulation medium such as fiberglass, rock wool or mineral wool will commonly be placed to fill the interior space between vertical studs and gypsum board panels. FIGS. 1*a*–1 *d* illustrate a cross-sectional top-down view of such constructions.

FIG. 1(*a*) shows prior art wall construction (100) comprised of vertical 2×4 studs (102) lined on each side by ⅝" gypsum board (101), with an air space (103) in between. The wall construction of FIG. 1*a* will typically have a Rw value of 33 and will be ~4¾" wide between exterior surfaces.

FIG. 1(*b*) shows prior art wall construction (200) comprised of vertical 2×4 studs (202) lined on each side by ⅝" gypsum board (201) with insulation (203) filling the interior space. The wall construction of FIG. 1(*b*) will typically have a Rw value of 38 and will be ~4¾" wide between exterior surfaces.

FIG. 1(*c*) shows prior art wall construction (300) comprised of 3⅝" vertical steel studs (302) lined on each side by ⅝" gypsum board (301) with air space (303) in between. The wall construction of FIG. 1(*c*) will typically have a Rw value of 33 and will be ~4⅞" ½" wide between exterior surfaces.

FIG. 1(*d*) shows prior art wall construction (400) comprised of 3⅝" vertical steel studs (402) lined on each side by ⅝" gypsum board (401) with insulation (403) filling the interior space. The wall construction of FIG. 1(*d*) will typically have a Rw value of 40 and will be ~4⅞" wide between exterior surfaces.

These conventional walls have proven over time to be sturdy, provide adequate privacy, and provide a surface that easily accepts wall hangings such as pictures, paintings, plaques and the like. Furthermore, as is commonly known, conventional walls can easily be repainted, retextured, and, readily patched and repaired when damaged. However, the acoustic properties of walls constructed by this method provide acoustic properties that often do not meet user needs.

To increase the sound attenuating properties of walls, numerous alternative practices have been used FIGS. 1(*e*)–1(*g*) provide top-down cross-sectional views of alternative constructions. It can be seen by comparison the FIGS. 1(*a*)–1(*d*), the wall constructions shown in FIGS. 1(*e*)–1(*g*) each have an overall wall thickness that FIG. 1(*e*) shows a prior art wall construction (500) wherein vertical 2×4 studs (502) are placed in a staggered configuration such that no direct rigid connection is made between gypsum board panels (501) lining each wall face. Insulation (503) is used to fill interior spaces. The overall wall thickness of prior art wall construction (500) typically exceeds 6".

FIG. 1(*f*) shows a prior art wall construction wherein vertical 2×4 studs (602) are placed in a two-wide configuration effectively doubling the overall wall thickness to ~9". Gypsum board (601) lines each face and insulation (603) fills interior spaces.

FIG. 1(*g*) is similar to FIG. 1(*f*) except the two-wide 2×4 studs are replaced by 7" steel studs (702) and two layers of gypsum board (701) are used on one side. Insulation (703) is used to fill interior spaces. The wall constructions illustrated in FIGS. 1(*f*) and 1(*g*) are able to provide $R_w$ values of up to 52. The wall construction of FIG. 1 *g*) has an overall thickness of ~9" and, by way of the double layer of gypsum board on one face, provides a one hour fire rating as required by many commercial applications such as hotel constructions.

Due to the ever increasing cost associated with commercial and residential construction and the subsequent need to maximize interior space while minimizing costs, there is a need in the art for economical interior wall constructions that provide both sound attenuating and fire resistance properties while minimizing wall thickness.

Further, since no two applications are identical, the need exists for such a system that provides the versatility to easily customize wall height and width to fit each individual application. The invention disclosed herein meets these needs, as well as providing a wall construction (800) that can be made primarily of recycled materials. The invention disclosed herein represents a significant improvement over existing art.

The compressed straw panels described in the disclosure contained herein, possess structural and acoustical properties very well suited for economically constructing interior walls with superior sound attenuating and fire resistant properties.

For comparison, FIG. 1(*h*) provides a cross-sectional top-down view of a very simple wall construction that utilizes said compressed straw panel.

FIG. 1(*h*) shows a 2¼" compressed straw panel (801) lined on each side by ⅝" gypsum board (802). Attachment is typically made by means of adhesives and or conventional fasteners such as nails or screws. The wall construction illustrated in FIG. 1 (*h*) has an overall thickness of 3½" and provides an $R_w$ value of 39.

Lacking in the art are interior wall construction methods that effectively utilize the favorable structural, acoustic and combustion properties of said compressed straw panels, especially the favorable properties achieved when used in concert with resilient channel members that define a space on one or both sides of a compressed straw panel.

SUMMARY OF THE INVENTION

The present invention relates to interior wall constructions. More particularly, the present invention relates to improved interior wall constructions that do not require vertical studs. Further, the present invention relates to improved interior wall constructions that utilize compressed straw panels in lieu of studs, either wood or otherwise. Further, said improved interior wall constructions provide improved sound attenuating properties and comparable fire resistance properties to conventional wall constructions with less wall thickness, thus better utilizing interior space.

In a preferred embodiment of subject wall construction, the present invention comprises a generally sandwich configuration with gypsum board sheets lining each of two faces of the wall. A compressed straw panel is situated between the gypsum board sheets in substantially planar orientation thereto. The compressed straw panel is connected to one of the gypsum board sheets by means of a plurality of resilient Z-channel connector members. The compressed straw panel is connected to the second gypsum board sheet by means of a rigid, non-resilient connector. Both connections define an air space located between the compressed straw panel and the gypsum board sheets attached thereto. Said air space defined by the resilient connectors is partially filled by a non-woven insulating medium. The air space defined by the non-resilient connector remains empty.

Compressed straw panel edge to edge connections utilize a steel H-channel member that fully engages the ends of two straw panels. Gypsum board sheet joints are aligned adjacent to said H-channel such that the steel H-channel member acts to eliminate a burn path between abutted straw panels and abutted gypsum board sheets.

The features and advantages of the invention will be further understood and appreciated by those skilled in the art by reference to the following written specification, claims, and appended drawings.

BRIEF DESCRIPTION OF THE DRAWINGS

The figures presented herein when taken in conjunction with the written disclosure form a complete description of the invention.

FIG. 1(*e–g*) also referred to supra, shows individual top-down cross-section views of prior art wall constructions.

FIG. 1(*h*) shows an individual top-down cross-section view of a prior art wall construction utilizing a compressed straw panel.

FIG. 2(*b* and *c*) shows a top-down cross-section view of a wall joint of the preferred embodiment in exploded form (b) and assembled form (c).

FIG. 2(*d*) shows a cross-section side view of the preferred embodiment.

FIG. 3(*b*) shows a top-down cross-section view of a wall joint of the first alternative embodiment.

FIG. 3(*c*) shows a cross-section side view of the first alternative embodiment.

FIG. 4(*b*) shows a top-down cross-section view of a wall joint of the second alternative embodiment.

FIG. 4(*c*) shows a cross section side view of the second alternative embodiment.

DETAILED DESCRIPTION OF THE INVENTION

The invention herein comprises a novel combination of five elements. Said elements being a compressed straw panel, a first resilient channel member, a second resilient Z-shaped channel member, insulating medium, gypsum board sheets, and properly placed air spaces.

Figure 6:
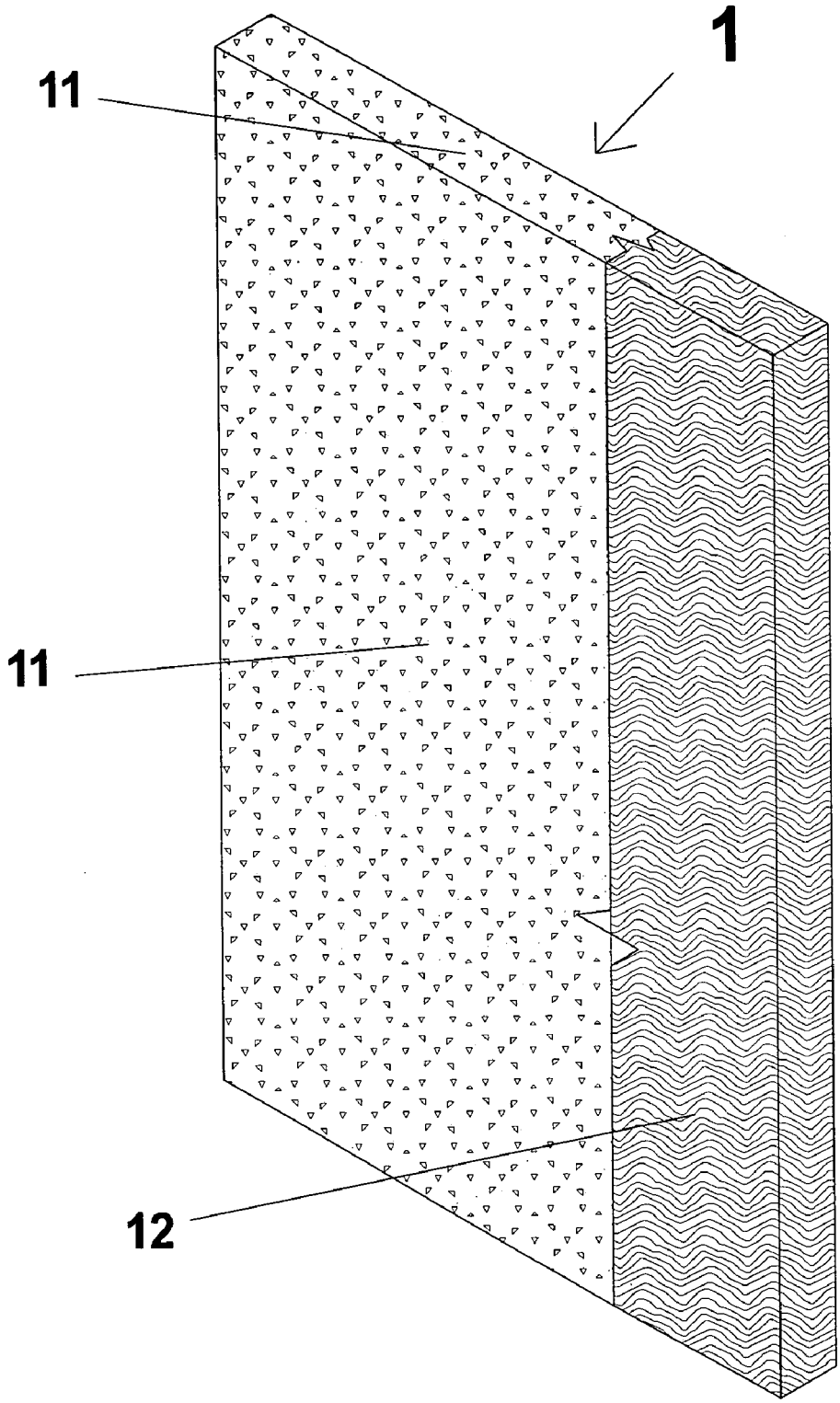
FIG. 6 shows a simple cutaway isometric view of an individual compressed straw panel.

The improved interior wall construction disclosed herein includes a number of individual components, but is generally designed around a compressed straw panel. In the preferred embodiment, compressed straw panels such as those manufactured by Affordable Building Systems of Texas are utilized. Each compressed straw panel is composed of highly compressed straw, typically wheat, rice, oat or other recovered agricultural straw lined on all exterior sides by paper or paperboard. Compressed straw panels are typically made through a dry extrusion process wherein straw is compressed into a substantially flat continuous web, normally between 1" and 3" thick and between 30" and 65" wide. As previously mentioned, the continuous web is lined on all sides by paper or paperboard. The continuous web is then cut into rectangular panels of various lengths. FIG. 6 is an isometric cutaway view of a simple compressed straw panel (1) showing the compressed straw fibers (12) and the paperboard liner (11). The compressed straw (12) is arranged in layers with the straw fibers substantially parallel in orientation extending transversely across the panel from side to side when the panel is in a normal in-use orientation. For reference, a typical completed panel will measure 4'×8'. When used, compressed straw panels will typically be oriented such that the longer edges are substantially vertical and the shorter edges are substantially horizontal. In this orientation, said compressed straw fibers (12) will assume a generally horizontal orientation.

Further, the compressed straw panels utilized in the invention disclosed herein provide a substantial structural base around which interior walls are easily constructed. A typical 4'×8' compressed straw panel of 2¼" thickness has a rack load rating of 1,103 lbs.—allowable and 2130 lbs.—ultimate, and a transverse load rating of 35.1 lbs./ft$^2$—allowable and 105.2 lbs./ft$^2$—ultimate as tested and rated according to ASTM E72-98. These panels are well suited for accepting nails, screws, and the like as evidenced by a nail pull rating of 109 lbs. as tested and rated according to ASTM C473-00. The strength of said compressed straw panels provide for a stud-less wall construction.

The acoustic and combustion properties of the compressed straw panels are of particular importance to the invention disclosed herein. A 2¼" thick panel has Class A flame spread rating (FSI=10, SDI=45) as tested and rated according to ASTM E-84, and an STC and $R_w$rating of 36 as tested and rated according to ASTM E90-99, E413-87, E1132-90, and ISO 717. The preferred embodiment herein disclosed infra, provides a one hour fire rating on both sides as tested and rated according to ASTM E-119.

The detailed description will continue with a figure by figure view of each embodiment of the subject wall construction.

FIG. 2(*a*) shows a cutaway isometric view of the preferred embodiment. As illustrated, the wall construction disclosed herein comprises a substantially sandwich configuration wherein each component is aligned in a substantially planar relative configuration. Compressed straw panel (1) is attached on first face to a plurality of rail channels (5) via attachment means (10). Said attachment means (10) may be a penetrating fastener such as a nail or screw, a strong adhesive such as an epoxy resin, or any combination thereof. Attachment means (10) are illustrated herein as penetrating fasteners. Said rail channels (5) are then attached to a first gypsum board sheet (3) via attachment means (10). Again said attachment means (10) may be a penetrating fastener such as a nail or screw, a strong adhesive such as an epoxy resin, or any combination thereof. Said first gypsum board sheet (3) comprises a first outer face of said wall construction. Said rail channels provide a first air space (8) between compressed straw panel (1) and said first gypsum board sheet (3). Compressed straw panel (1) is attached on second face to a plurality of Z-channels (2). As illustrated, each Z-channel is then attached to a second gypsum board sheet (3) that comprises a second outer face of said wall construction. Attachment means (10) between said Z-channels (2) and said compressed straw panel (1), and between said Z-channel (2) and said gypsum board sheet (3) can comprise any conventional attachment means such as nails, screws, adhesives, or any combination thereof. Rail channels (5) and Z-channels (2) should be situated in substantially parallel, but horizontally staggered orientation, as illustrated in FIG. 2(*a*), in order to minimize sound transmission therethrough. Further, a configuration wherein a rail channel (5) and Z-channel (2) lie in the same horizontal plane on opposing sides of compressed straw panel (1) produces an improved path for sound transmission and is therefore undesirable. For comparison, the preferred embodiment, shown by FIGS. 2(*a–d*) provides a minimum $R_w$ value of 57 while having an overall wall thickness of ~5".

Referring now to FIG. 2(*d*), it can be seen that placed adjacent to said second face of compressed straw panel (1) is an insulation material (4). Said insulation is preferably a non-woven material made of fiberglass, rock wool or mineral wool with a density in the range of 0.7–4.0 lbs/ft$^3$ (11.2–64.2 kg/m$^3$). In the preferred embodiment, insulation material (4) is fiberglass with a density of 2 lbs/ft$^3$ and a thickness of 3 in. Importantly, said insulation (4) does not completely fill the space between compressed straw panel (1) and second gypsum board panel (3) and provides for a second air space (9) between said insulation (4) and said second gypsum board panel (3). It is recommended that said insulation (4) be attached to said compressed straw panel to insure that second air space (9) is not compromised. The preferred attachment between said insulation (4) and said compressed straw panel (1) is by adhesive. Many commercially available adhesives are suitable, and a polyvinyl acetate based adhesive is preferred.

Still referring to FIG. 2(*d*) said first air space (8) between compressed straw panel (1) and first gypsum board panel can be seen. In the preferred embodiment, first air space (8) is approximately ½" wide and second air space (9) is approximately 1" wide.

Referring now to FIG. 2(*b*), an exploded sectional top-down view of a wall joint of the preferred embodiment is shown. It can be seen that steel H-channel (6) is further comprised of first receiving channel (61) and second receiving channel (62) each of which is sized to securely accept an edge of one compressed straw panel therein. Said receiving channels (61 & 62) are preferrably sized to provide a tight fit between H-channel (6) and compressed straw panel (1) such that supplemental attachment means such as screws or nails are not needed to maintain retention after initial insertion.

FIG. 2(*c*) shows the same wall joint in a fully assembled configuration. Importantly, FIG. 2(*c*) illustrates that the gypsum board joints (7) between each gypsum board sheet (3) are substantially aligned with the middle of said H-channel (6) as shown. Gypsum board joints (7) wherein two gypsum board panels are aligned in an edge to edge abutted relationship create a burn through path for fires. Said alignment between gypsum board joints (7) and H-channel (6) places a steel fire resistant barrier in the burn through path, thus imparting important fire resistance properties to subject wall construction.

Figure 1A:
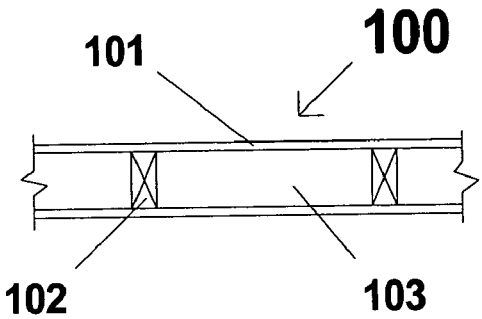
FIG. 1(*a–d*) referred to supra, shows individual top-down cross-section views of prior art wall constructions.
Figure 1B:
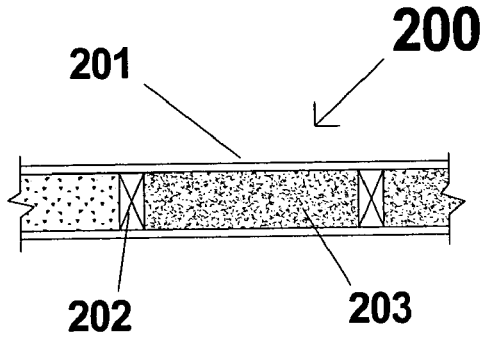
Figure 1C:
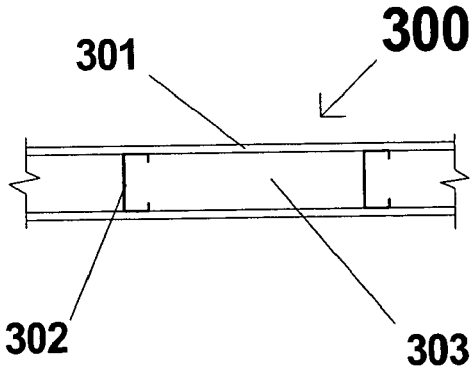
Figure 1D:
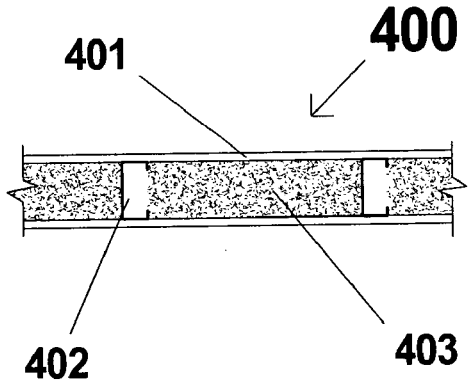
Figure 1E:
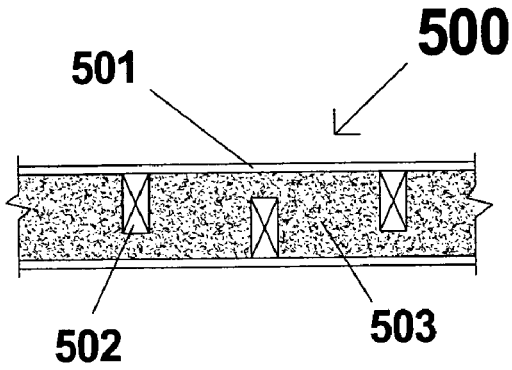
Figure 1F:
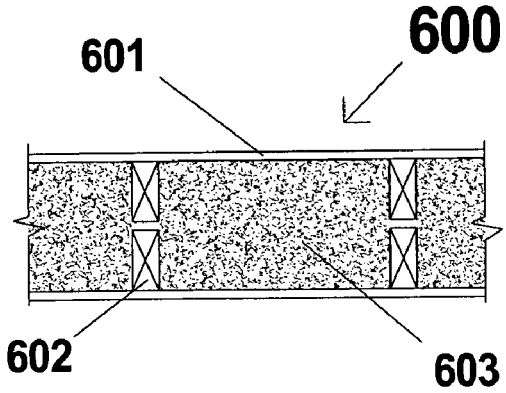
Figure 1G:
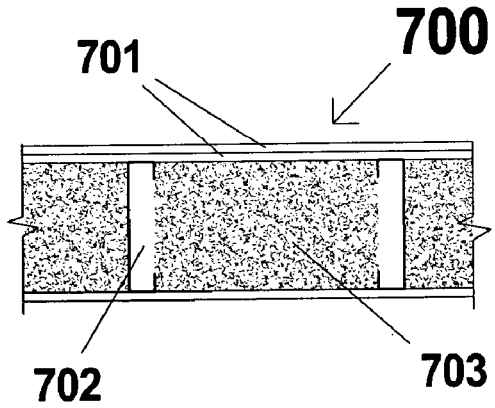
Figure 1H:
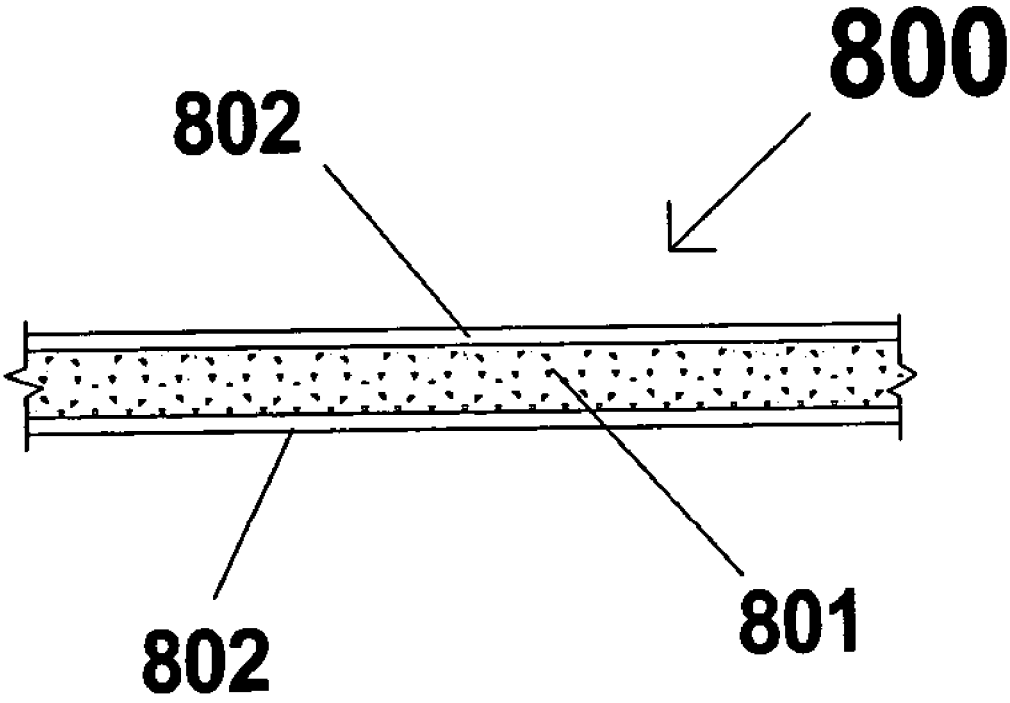
Figure 2A:
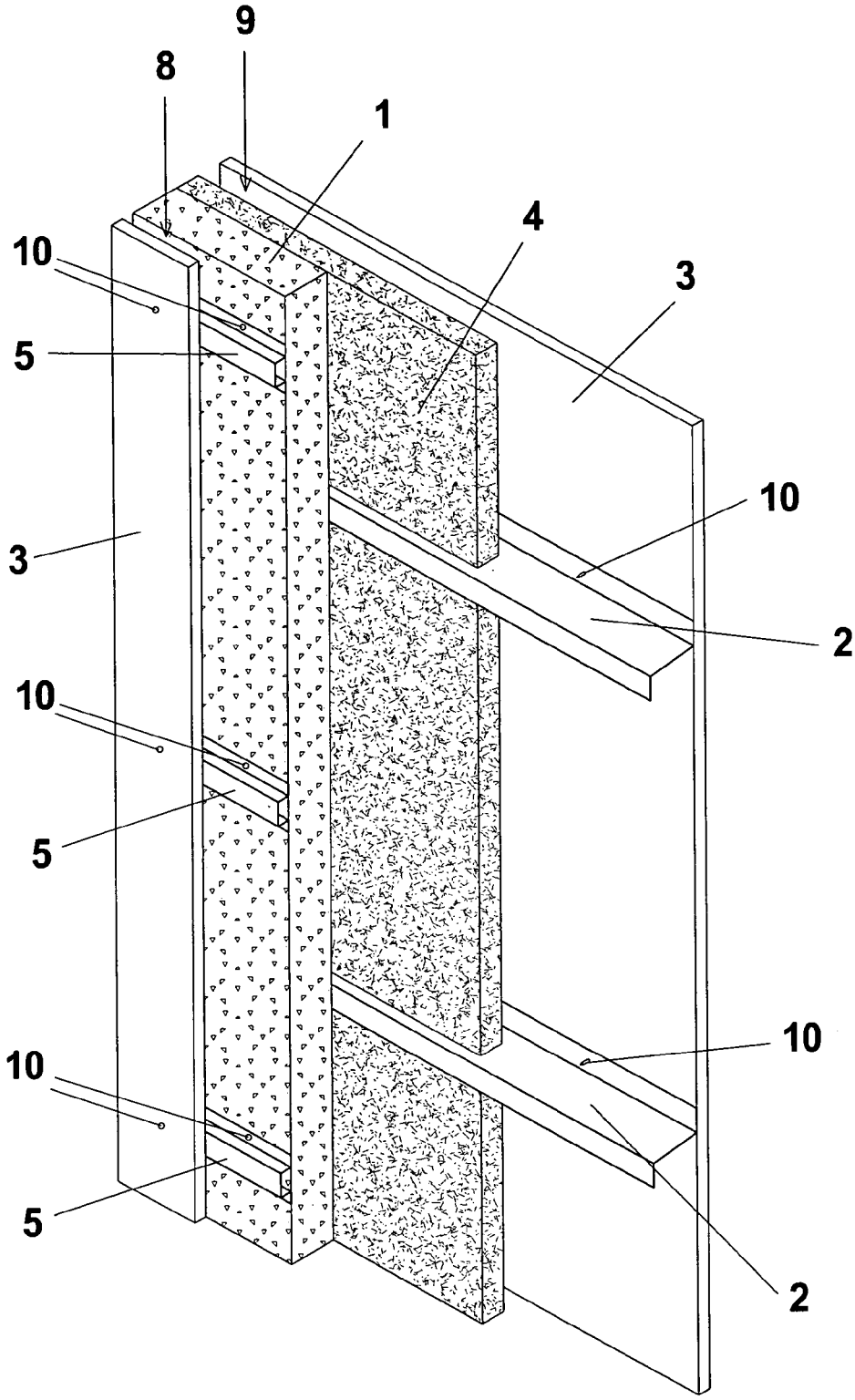
FIG. 2(*a*) shows an isometric cutaway view of the preferred embodiment of subject invention.
Figure 2B:
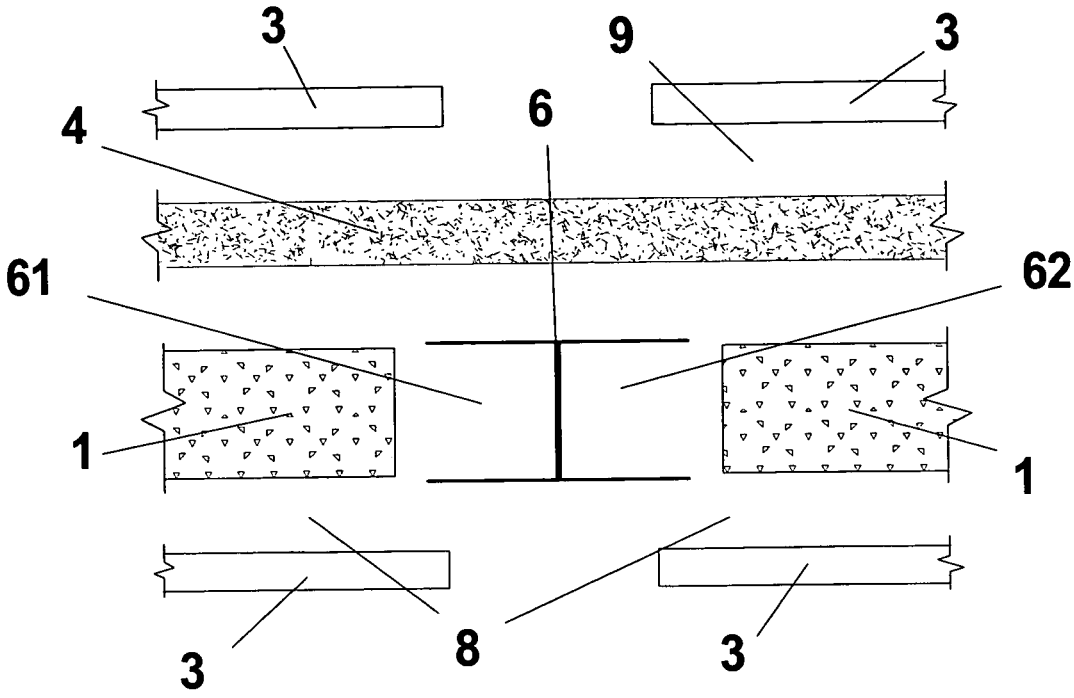
Figure 2C:
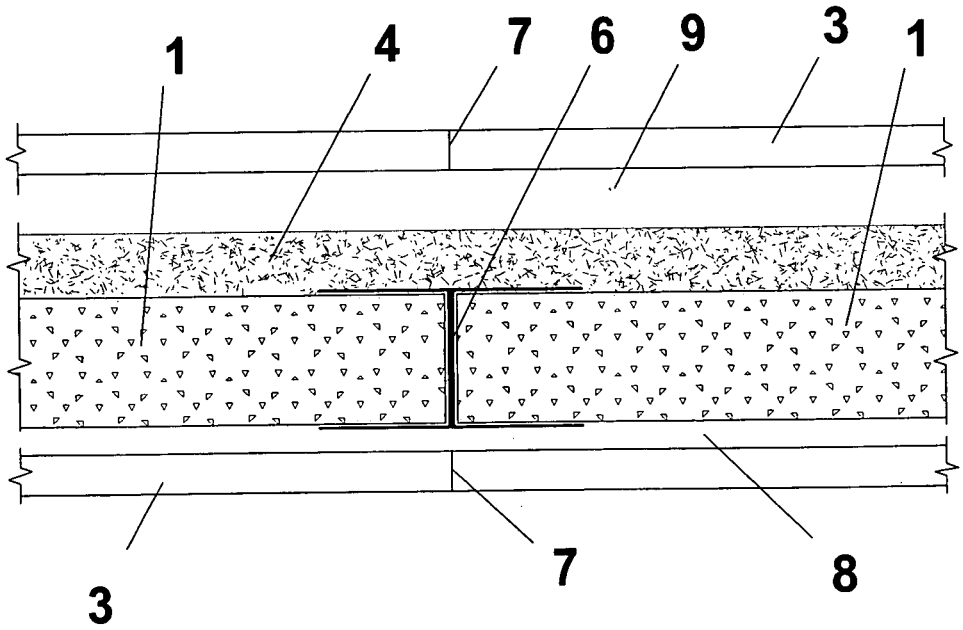
Figure 2D:
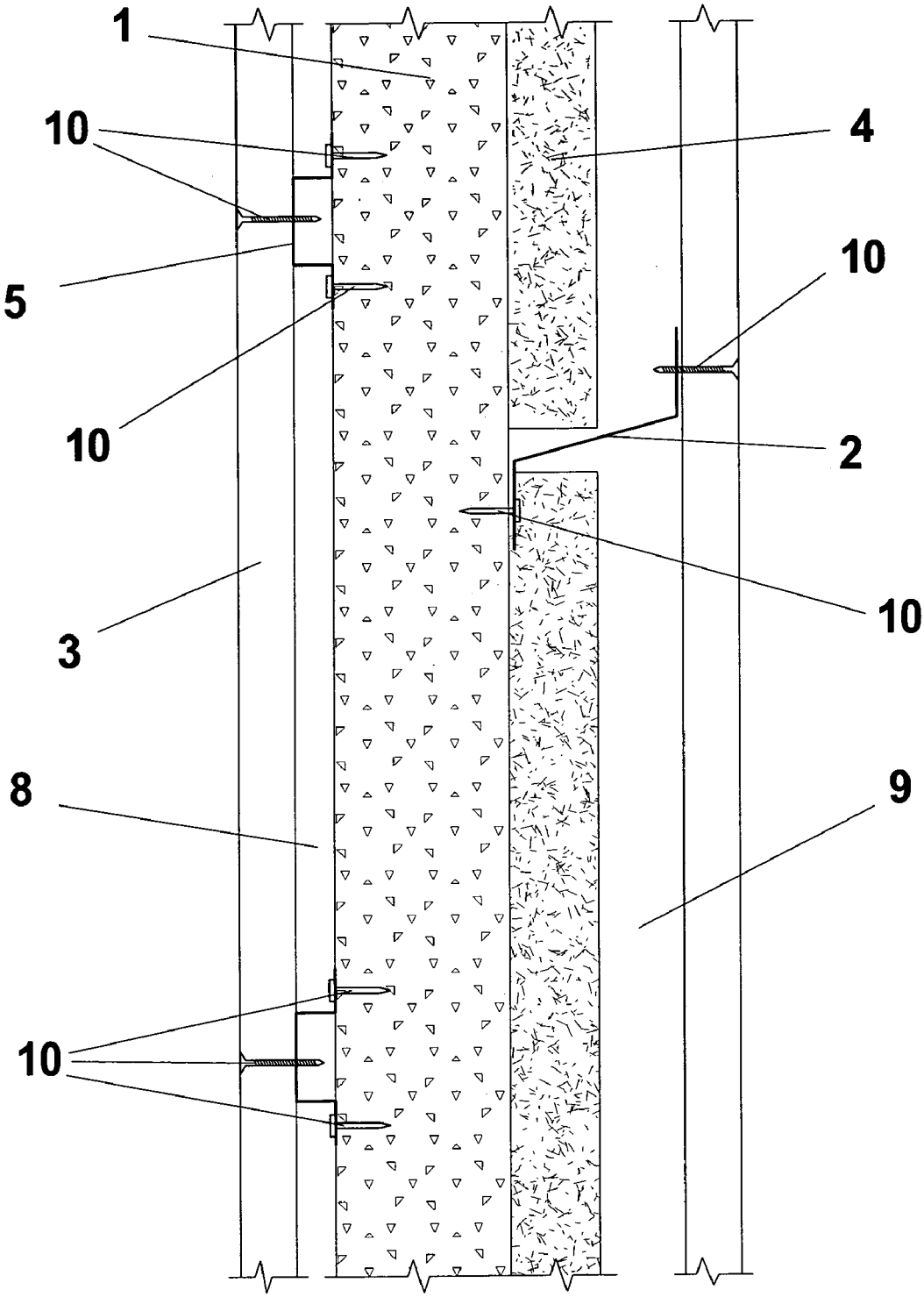
Figure 3A:
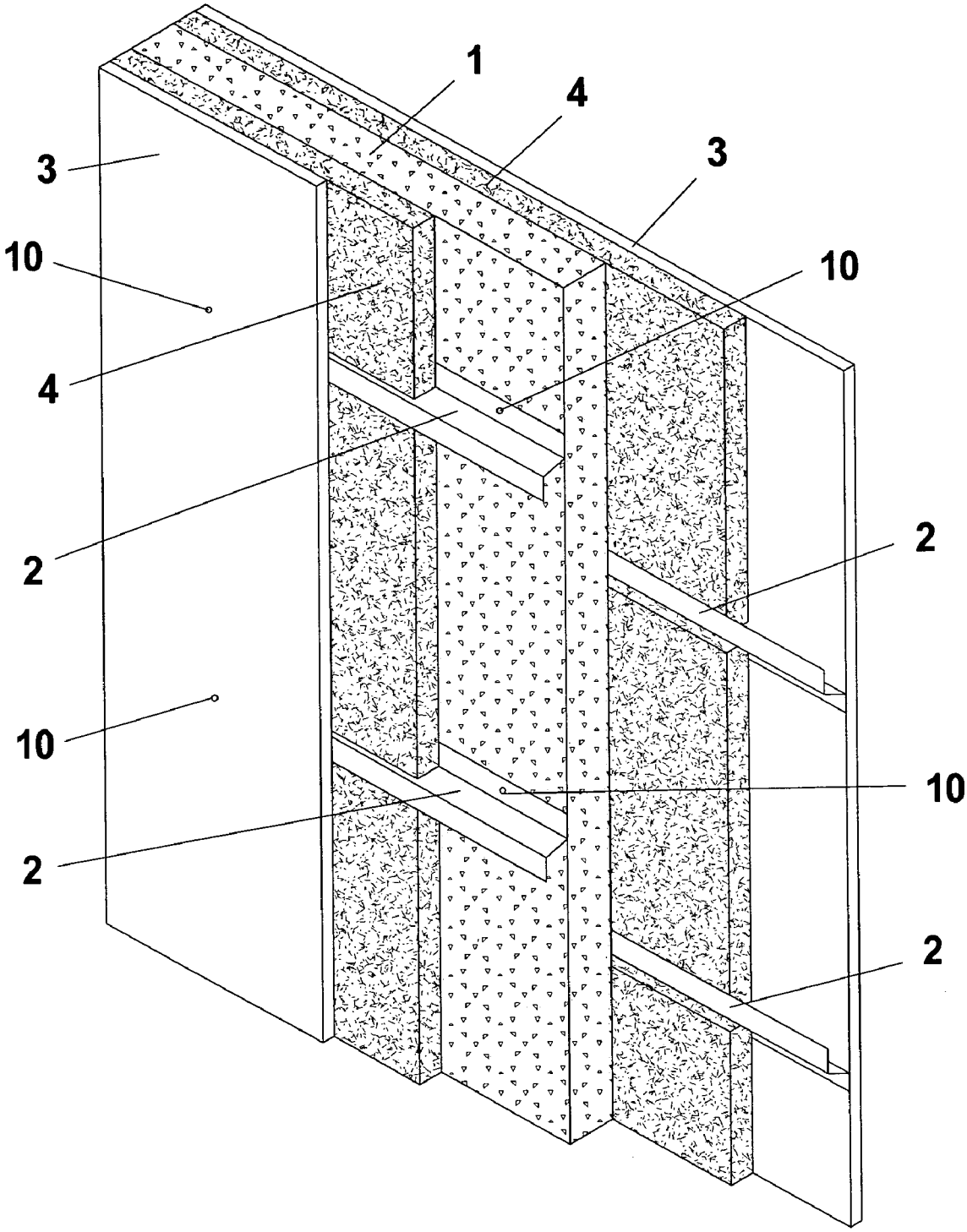
FIG. 3(*a*) shows an isometric cutaway view of a first alternative embodiment of subject invention.
Figure 3B:
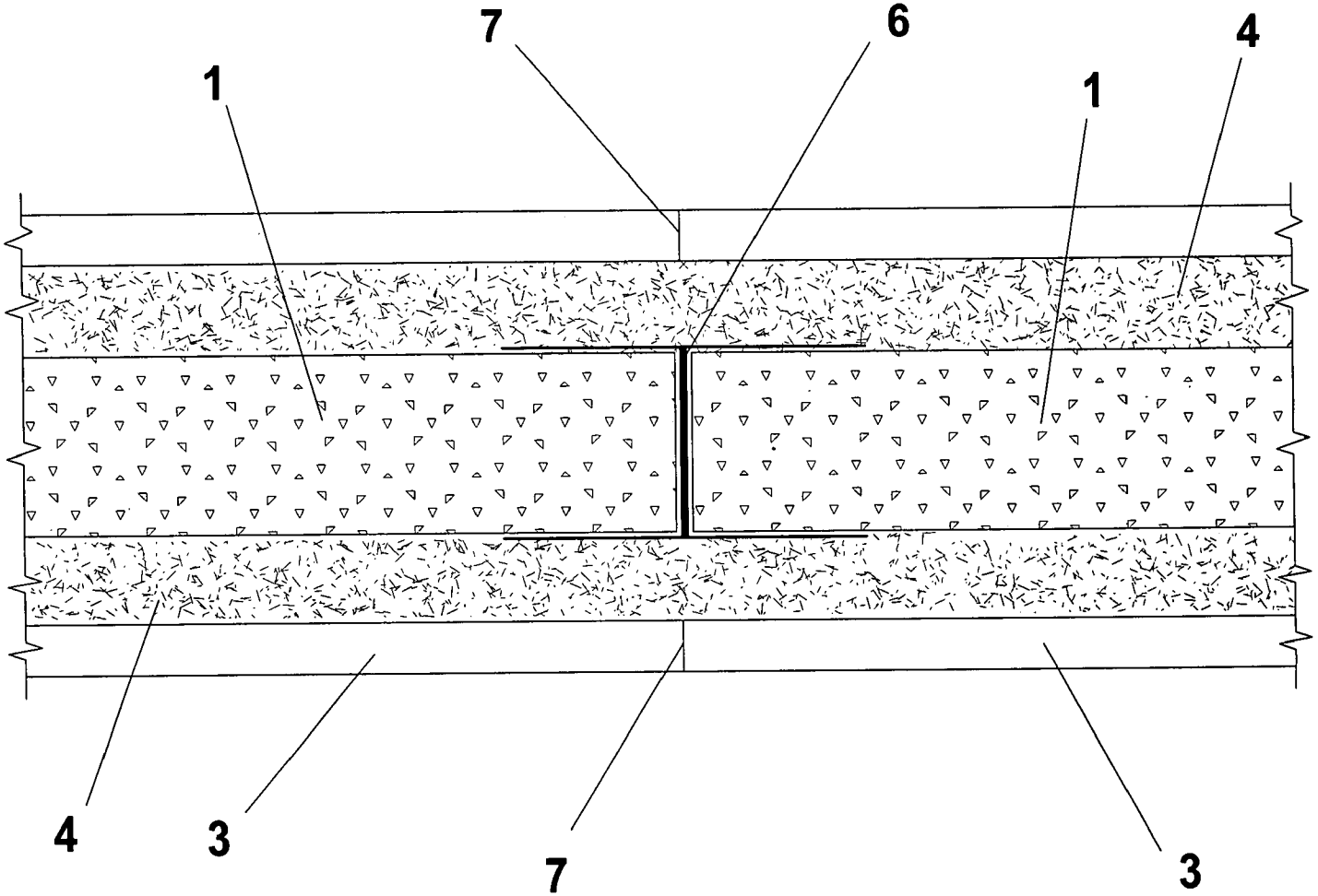
Figure 3C:
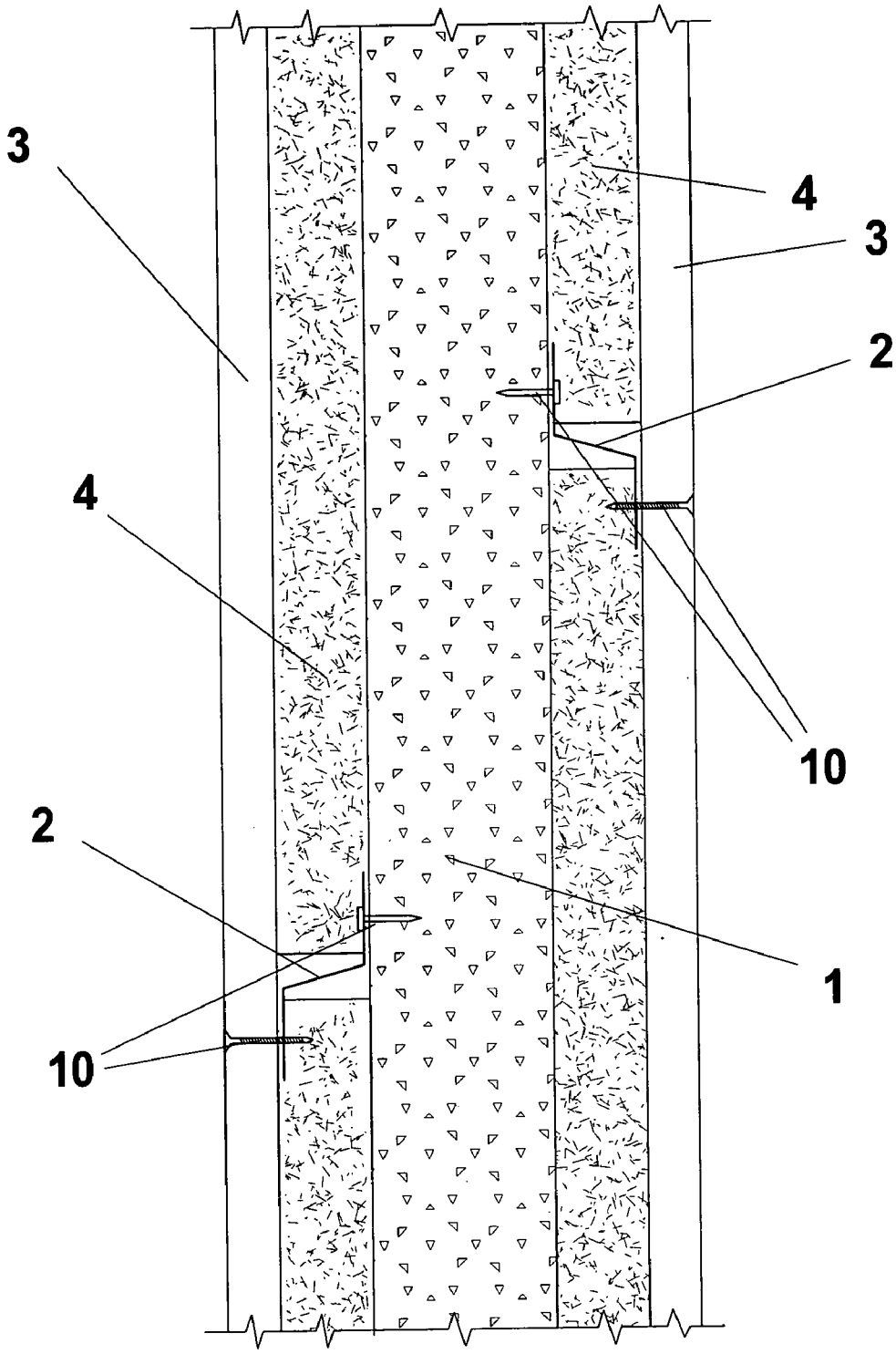

Referring to FIG. 3(*a*), an isometric cutaway view of a first alternative embodiment is shown. The first alternative embodiment also comprises a substantially sandwich configuration with each component aligned in substantially planar relative configuration. Compressed straw panel (1) is attached on first face to a plurality of Z-channel members (2) via attachment means (10). As with the preferred embodiment, said attachment means (10) may be a penetrating fastener such as a nail or screw, a strong adhesive such as an epoxy resin, or any combination thereof. Said Z-channels (2) are then attached to a first gypsum board sheet (3) via attachment means (10). Again said attachment means (10) may be a penetrating fastener such as a nail or screw, a strong adhesive such as an epoxy resin, or any combination thereof. Said first gypsum board sheet (3) comprises a first outer face of said wall construction. As illustrated in FIG. 3 (*a*), the space between compressed straw panel (1) and first gypsum board sheet (3) is filled by insulation (4). In the first alternative embodiment, said insulation (4) is preferably a non-woven material made of rock wool or fiberglass and in a bat form. Compressed straw panel (1) is attached on second face to a plurality of Z-channels (2). As illustrated, each Z-channel is then attached to a second gypsum board sheet (3) that comprises a second outer face of said wall construction. Attachment means (10) between said Z-channels (2) and said compressed straw panel (1), and between said Z-channel (2) and said gypsum board sheet (3) can comprise any conventional attachment means such as nails, screws, adhesives, or any combination thereof. As illustrated, Z-channels (2) on opposite sides of compressed straw panel (1) should be substantially parallel, but horizontally staggered orientation in order to minimize sound transmission therethrough. A configuration wherein two Z-channel (2) lie in the same horizontal plane on opposing sides of compressed straw panel (1) produces an improved path for sound transmission and is therefore undesirable. In the first alternative embodiment, insulation (4) is preferably attached to compressed straw panel (1) by means of glue, adhesive or other suitable fastening means.

FIG. 3(*b*) shows a sectional top-down view of a wall joint of the first alternative embodiment. As with the preferred embodiment, H-channel (6) fully accepts the edge of two compressed straw panels (1) therein as shown. As with the preferred embodiment, gypsum board joints (7) between each gypsum board sheet (3) are substantially aligned with the middle of said H-channel (6) to preclude a burn through path.

From FIG. 3(*c*), a sectional side view of first alternative embodiment, it can be seen that insulation (4) is placed adjacent to both first and second face of compressed straw panel. As with the preferred embodiment, said insulation is a non-woven material made of fiberglass, rock wool or mineral wool with a density in the range of 0.7–4.0 lbs/ft$^3$ (11.2–64.2 kg/m$^3$). In the first alternative embodiment as illustrated, insulation (4) completely fills the space between first and second face of compressed straw panel (1) and first and second gypsum board sheets (3). The only exception being the small space above and below Z-channel (2) that is created due to the non-right angle of said Z-channel. As previously mentioned, It is recommended that said insulation (4) be attached to said compressed straw panel by adhesive or other suitable means.

Figure 4A:
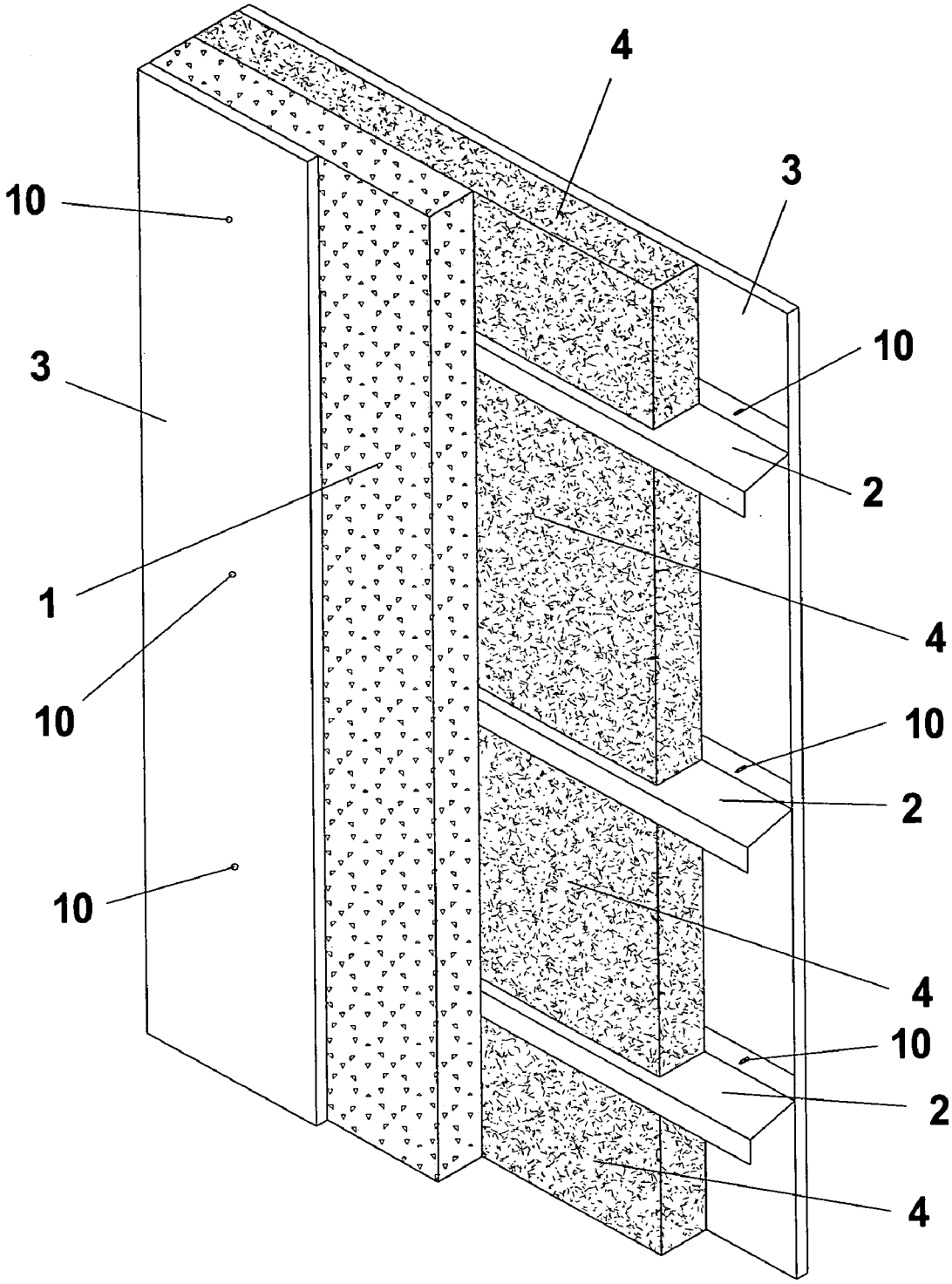
FIG. 4(*a*) shows an isometric cutaway view of a second alternative embodiment of subject invention.
Figure 4B:
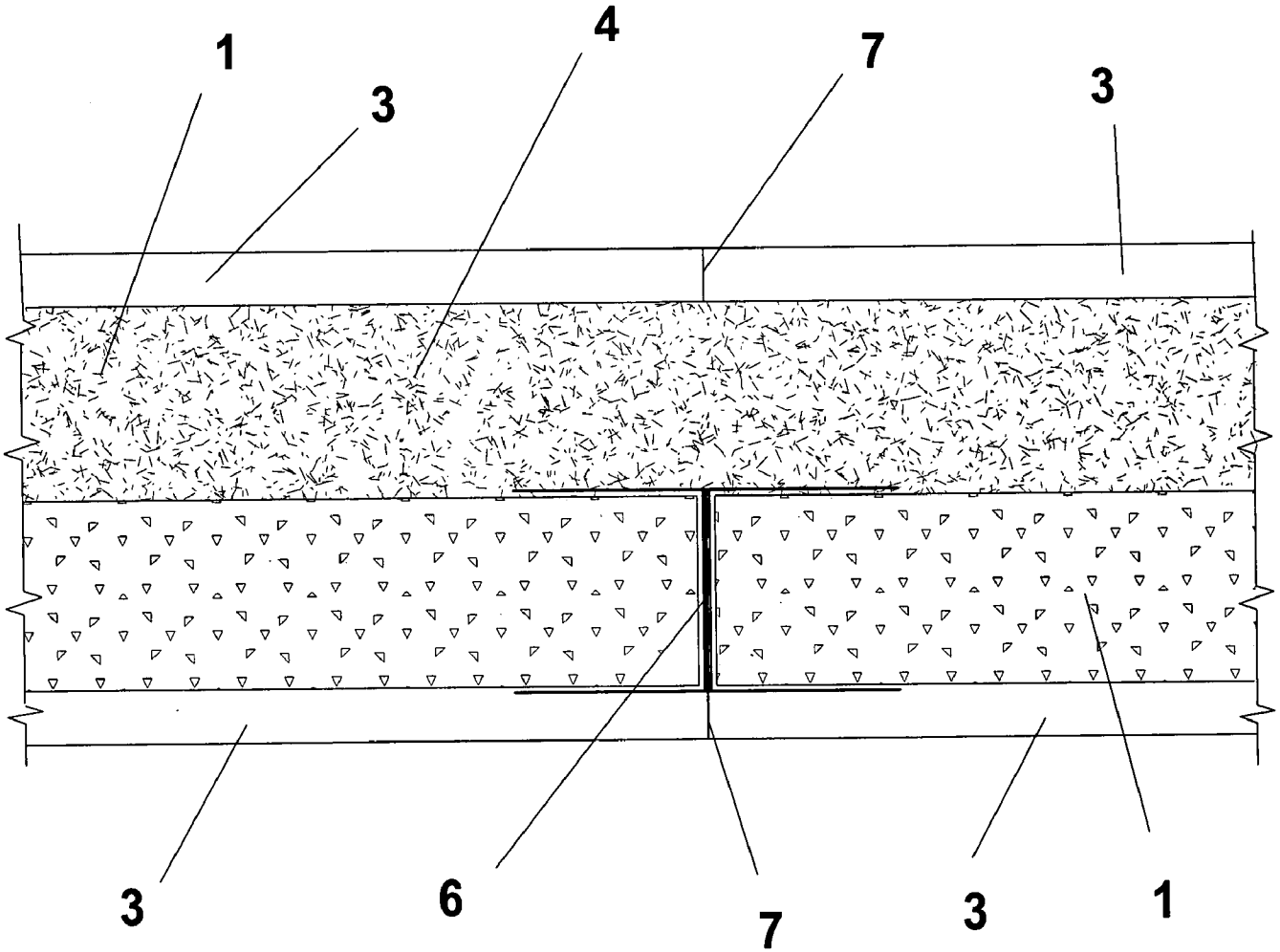
Figure 4C:
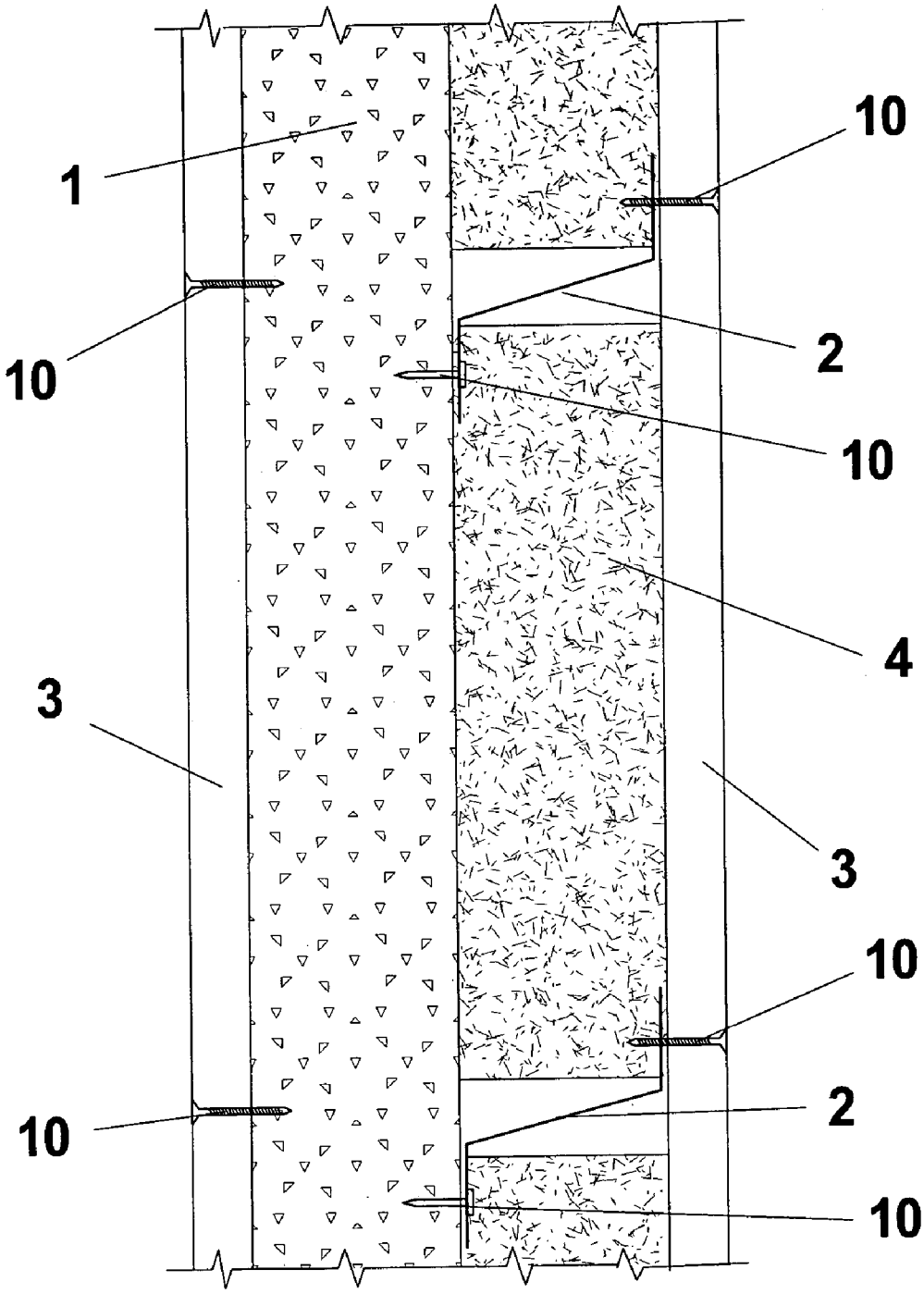

Referring to FIG. 4(*a*), an isometric cutaway view of a second alternative embodiment is shown. The second alternative embodiment also comprises a substantially sandwich configuration with each component aligned in substantially planar relative configuration. Compressed straw panel (1) is attached on first face directly to a gypsum board sheet (3) by attachment means (10). Said first gypsum board sheet comprises first outer face of wall construction. In this embodiment, attachment means (10) may be a penetrating fastener such as a nail or screw, a strong adhesive such as an epoxy resin, or any combination thereof. Compressed straw panel (1) is attached on second face to a plurality of Z-channels (2). As illustrated, each Z-channel is then attached to a second gypsum board sheet (3) that comprises a second outer face of said wall construction.

Attachment means (10) between said Z-channels (2) and said compressed straw panel (1), and between said Z-channel (2) and said gypsum board sheet (3) can comprise any conventional attachment means such as nails, screws, adhesives, or any combination thereof. As illustrated, Z-channels (2) should be positioned in substantially parallel relative orientation. In the second alternative embodiment, as illustrated, insulation (4) completely fills the space between second face of compressed straw panel (1) and second gypsum board sheet (3) and is preferably attached to compressed straw panel (1) by means of glue, adhesive or other suitable fastening means.

FIG. 4(*b*) shows a sectional top-down view of a wall joint of the second alternative embodiment. As with previous embodiments, H-channel (6) fully accepts the edge of two compressed straw panels (1) therein as shown, and gypsum board joints (7) between each gypsum board sheet (3) are substantially aligned with the middle of said H-channel (6) to preclude a burn through path.

In FIG. 4(*c*) a sectional side view of second alternative embodiment is shown. Here it can be seen that insulation (4) is placed between second face of compressed straw panel (1) and second gypsum board sheet (3). Said insulation (4) completely fills the space therebetween except for just above and below Z-channels (2) as shown. Here again, it is recommended that said insulation (4) be attached to said compressed straw panel by adhesive or other suitable means.

Figure 5A:
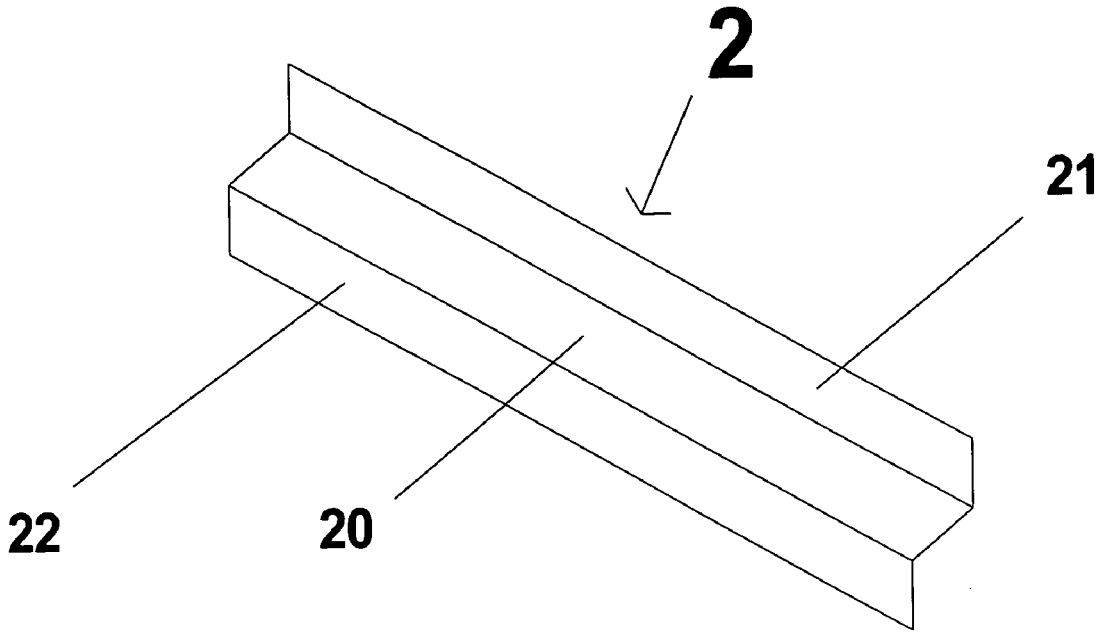
FIGS. 5(*a* and *b*) shows individual detailed views of a Z-channel member in an isometric view (a) and a cross-section side view (b).
Figure 5B:
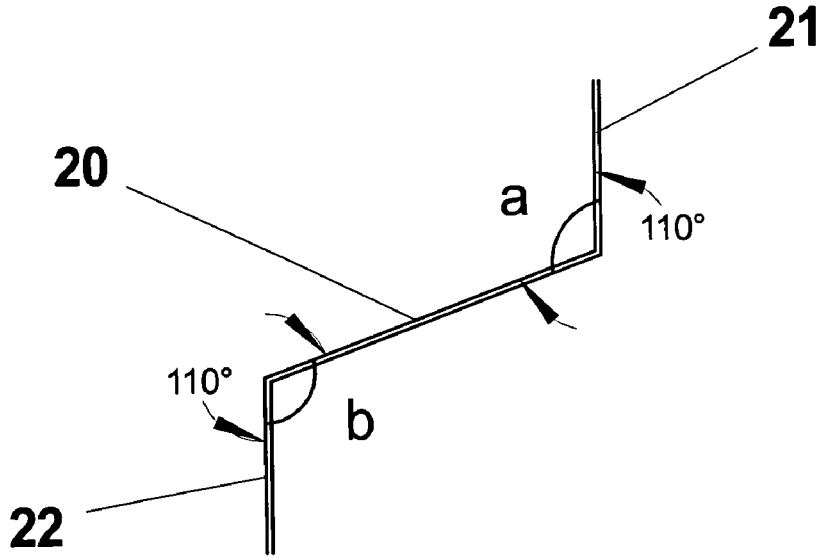

An important element of this invention is the Z-channel. FIGS. 5(*a*) and 5(*b*) illustrate an isometric and cutaway view of the Z-channel respectively. Referring first to FIG. 5(*a*), the Z-channel (2) is comprised of three substantially flat elements, spine member (20), first flange member (21) and second flange member (22). In the preferred embodiment, Z-channel (2) has resilient characteristics and is made light gauge steel (20 gauge). Z-channel (2) can be made of any material-with a Young's modulus equal to or less than $30\times10^6$ lbs/in$^2$ (206.8 Gpa), and a melting temperature equal to or greater than 2500° F. (1370° C.). FIG. 5(*b*) further illustrates the angles a and b between spine member (20) and flange members (21) and (22) respectively. In the preferred embodiment, angles a and b, which are equal, are each greater than 98°. For illustration, FIG. 5(*b*) shows angles of 110°.

As discussed herein, the disclosure comprise improved interior wall constructions. The walls can be constructed as disclosed and repeated in planar side by side fashion to construct continuous walls of the length desired. It is recommended that the wall finished wall height constitute one panel. In other words an 8' high wall should be constructed compressed straw panels 8' in length placed in continuous side by side fashion with panel joints achieved as illustrated in FIGS. 2(*c*), 3(*b*) and 4(*b*). Attachment of the disclosed walls at the top and bottom to a ceiling and floor respectively may be done by any conventional means and is not within the scope of this invention. Termination of the disclosed walls at an exterior wall or abutting to another interior wall may also be done by any conventional means and is not within the scope of this invention.

The gypsum board sheets referred to herein are preferably ⅝" type-X gypsum board as commonly manufactured by most gypsum board manufacturers. As with normal drywall installation, gypsum board sheets utilized in the wall construction disclosed herein can be cut, sized, taped, bedded, textured and finished as with conventional drywall applications.

Those skilled in the art will recognize that certain variations or alternative embodiments are easily accomplished with the invention disclosed herein. For example, the individual concepts can easily be used with core panels made from alternative materials. Further, alternative materials may well be used in the various component parts without deviating from the invention claimed herein.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts within the principles of the inventions to the full extent indicated by the broad meaning of the terms of the attached claims.

The restrictive description and drawings of the specific examples herein do not point out what an infringement of this patent would be, but are to provide at least one explanation of how to use and make the inventions. The limits of the inventions and the bounds of the patent protection are measured by and defined in the following claims.

What is claimed is:

1. An improved wall construction, comprising:

a compressed straw panel, said compressed straw panel being comprised of compressed straw or other cellulosic fibers and having a substantially rectangular shape and having first and second sides;

a first gypsum board sheet, said first gypsum board sheet having a substantially rectangular shape, inside and outside faces, and being oriented adjacent and planar to said first side of said compressed straw panel;

first penetrating fastener means attaching said first gypsum board sheet to said first side of said compressed straw panel;

a plurality of resilient z-channel members, said z-channel members each having a substantially elongated shape and a substantially "Z" shaped cross section and having first and second flanges, said first flange being contained in a first plane which is parallel to a second plane containing said second flange fastener means attaching said first flange of said z-channel members to said second side of said compressed straw panel;

a second gypsum board sheet, said second gypsum board sheet having a substantially rectangular shape, inside and outside faces, and being oriented adjacent and planar to said second side of said compressed straw panel and spaced so as to create a uniform air space therebetween;

second penetrating fastener means attaching said second gypsum board sheet to said second flange of said z-channel members; and insulating material, said insulating material positioned between said second side of said compressed straw panel and said inside face of said second gypsum board sheet, said insulating material further sized to substantially and uniformly cover said second side of said compressed straw panel and partially fill said air space.

2. The improved wall construction of claim 1, wherein said z-channel members each comprise:

a web member, said web member being substantially flat and having first and second edges;

said first flange of each of said z-channel members being substantially flat and having inside and outside edges, said inside edge being rigidly connected to said first edge of said web member, said first flange being oriented with respect to said web member as to provide an angle therebetween greater than 98°;

said second flange of each of said z-channel members being substantially flat and having inside and outside edges, said inside edge being rigidly connected to said second edge of said web member, said second flange oriented with respect to said web member as to provide an angle therebetween greater than 98°.

3. The improved wall construction of claim 2, wherein said z-channel members are made of a material having a melting temperature above 2400° F. and a Young's modulus below $30\times10^6$ lbs./in$^2$.

4. The improved wall construction of claim 3, wherein said z-channel members are made of material selected from the group consisting of steel, iron containing alloys, aluminum containing alloys, copper containing alloys, thermoplastic polymers, and thermosetting polymers.

5. The improved wall construction of claim 1, wherein said air space between said second side of said compressed straw panel and said inside face of said second gypsum board sheet is at least 2" wide.

6. The improved wall construction of claim 1, wherein said insulating material fills not more than 75% of a volume of said air space.

7. The improved wall construction of claim 1, wherein said insulating material has a substantially rectangular shape, is adhered to and substantially lines said second side of said compressed straw panel and has a thickness not more than 75% of the distance of a line normal to said second side of said compressed straw panel and said inside face of said second gypsum board sheet.

8. The improved wall construction of claim 1, wherein said insulating material substantially fills 100% of a volume of said air space.

9. The improved wall construction of claim 1, wherein said insulating material has a substantially rectangular shape, is adhered to and substantially lines said second side of said compressed straw panel and has a thickness equal to the distance of a line normal to said second side of said compressed straw panel and said inside face of said second gypsum board sheet.

10. The improved wall construction of claim 1, wherein said fastener means are selected from a group consisting of nails, brads, tacks, staples, screws, lag screws, rivets, bolts, lag bolts, machine bolts, carriage bolts, stove bolts, toggle bolts, anchor bolts, adhesives, and any combination thereof.

11. The improved wall construction of claim 1, wherein said first and second penetrating fastener means are selected from a group consisting of nails, brads, tacks, staples, screws, lag screws, rivets, bolts, lag bolts, machine bolts, carriage bolts, stove bolts, toggle bolts, anchor bolts, adhesives, and any combination thereof.

* * * * *